United States Patent [19]

Nardulli

[11] Patent Number: 4,918,840

[45] Date of Patent: Apr. 24, 1990

[54] FOOTWEAR FASTENER

[76] Inventor: Elisa Nardulli, 4828 Denney Ave., North Hollywood, Calif. 91601

[21] Appl. No.: 301,847

[22] Filed: Jan. 26, 1989

[51] Int. Cl.[5] ..... A43B 11/00; A43B 11/12

[52] U.S. Cl. ..... 36/50; 36/51; 36/52

[58] Field of Search ..... 36/50, 51, 52

[56] References Cited

U.S. PATENT DOCUMENTS

| | | | |
|---|---|---|---|
| 557,207 | 3/1896 | Judson | 36/50 X |
| 2,345,057 | 3/1944 | Marinetti | 36/50 |
| 2,883,771 | 4/1959 | Sanchez | 36/50 |
| 2,891,328 | 6/1959 | Volk | 36/50 |
| 3,855,715 | 12/1974 | Johnson | 36/50 |

*Primary Examiner*—Donald Watkins

*Attorney, Agent, or Firm*—Michael R. Collins

[57] ABSTRACT

Footwear Fastener is a logical and comfortable alternative to lacking shoes. It will adapt to any shoe. A zipper with loops sewn on the bottom and buttons on top allow the show wearer to lace the loops through existing eyelets and hook around the buttons. To tighten the fit of the shoe the wearer wraps the elastic cord around the button until the desired fit is achieved. With the apparatus secure to tighen shoes all the wearer needs to do is zip the apparatus shut.

1 Claim, 1 Drawing Sheet

FIG. 1
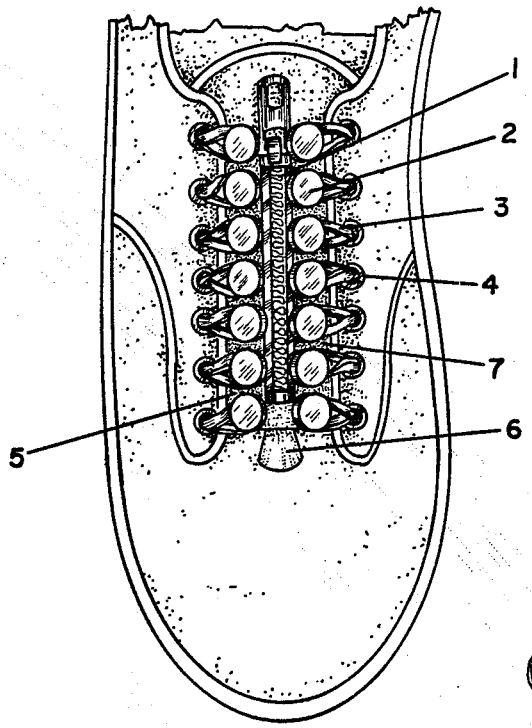
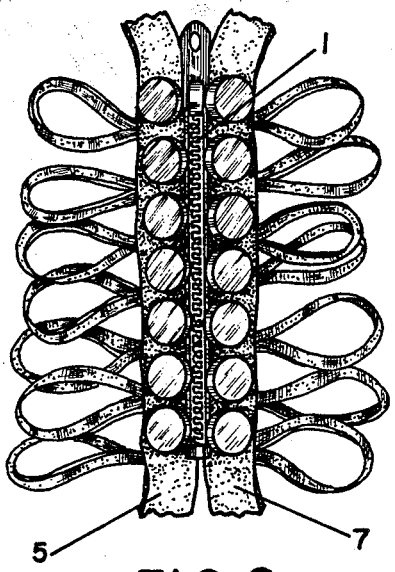
FIG. 2
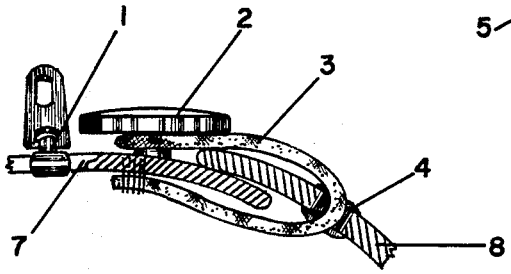
FIG. 3

FOOTWEAR FASTENER

FIELD OF INVENTION

The present invention relates to a footwear fastener that uses a zipper to secure a shoe instead of shoe strings. Attached to a zipper are loops which are laced through the eyelets of an ordinary shoe and hooked to buttons on the top of the zipper. The elastic cords on both sides of the zipper ensure a tight fit by tightening where needed.

DESCRIPTION OF PRIOR ART

Shoes have eyelets which are normally laced with shoe strings and tightened then tied. While this is an adequate method of securing shoes, when one string breaks a new one is needed. Also regular shoe laces need to be loosened and tightened regularly.

The present inventive idea provides an alternative which uses a zipper as the footwear fastener. It bypasses the need to tie shoes. This is also easier for young children and disabled persons who can not tie there shoes. The invention is also artistic since buttons can be shiny or different colors.

SUMMARY OF OBJECTIVES OF THE INVENTION

A primary object of the present invention is to provide a simple and fast method of tightening shoes. The basic design uses a zipper which is attached to the shoe by loops which go through existing eyelets.

In accordance with the description present herein other objects of this invention will become apparent when the description and drawings presented are reviewed.

BRIEF DESCRIPTION OF THE DRAWING

FIG. 1: Illustrates the footwear fastener on a shoe with the zipper closed.

FIG. 2: Illustrates the footwear fastener unattached to a shoe.

FIG. 3: Illustrates a side view of a portion of the footwear fastener.

FIG. 4: Illustrates a side view of the button hook.

DESCRIPTION OF THE PREFERRED EMBODIMENT

The footwear fastener is a zipper attached to a shoe. The attachment is through a button loop system which uses the pre-existing eyelets of the shoe. After installation all that needs to be done is to zip the shoes.

Referring to FIGS. 1 and 2 the zipper (1) is attached to heavy fabric (5), (7). The zipper will tighten and loosen the shoes allowing the wearer to put on or take off the shoes.

The zipper (1) and left and right heavy fabric pieces (5), (7) are attached to the shoe by a button and loop system. Buttons (2) are sewn onto the upper sides of the left and right heavy fabric pieces (5), (7) and elastic string loops (3) are sewn onto the bottom of the left and right heavy fabric (5), (7) pieces.

The loops (3) are laced with a hook (9) through the eyelets (4) of the shoe (8) and looped around the buttons (2) securely attaching the foot fastener to the shoe (8). After eight to twelve loops are made the foot fastener should be firmly attached. Now all the shoe requires is to be zipped closed. To tighten the shoe (8) the wearer wraps the elastic loop (3) around the button (2) until the desired fit is achieved.

A leather tab (6) at the bottom of the footwear fastener assist in counter pulling the footwear fastener so that it is easier to zip. A button hook can be used for ease of pulling the elastic loop (3) through the eyelet (4).

I claim:

1. Apparatus for tightening shoes, which comprises:

a. a zipper;

b. buttons, sewn to the top surface of the zipper; and c. elastic loops, sewn to the zipper, which loop through the existing eyelets of a shoe and loop around the buttons.

* * * * *